US006820838B2

(12) United States Patent
Martin et al.

(10) Patent No.: US 6,820,838 B2
(45) Date of Patent: Nov. 23, 2004

(54) REEL FOR WIRE

(76) Inventors: John Martin, 10 Old Ferry Cove, Beaufort, SC (US) 29902; Otis Norris, 2496 Brannon Rd., Bethune, SC (US) 29009; Thomas Plyler, P.O. Box 426, Jefferson, SC (US) 29718

( * ) Notice: Subject to any disclaimer, the term of this patent is extended or adjusted under 35 U.S.C. 154(b) by 0 days.

(21) Appl. No.: 10/638,195

(22) Filed: Aug. 8, 2003

(65) Prior Publication Data

US 2004/0026561 A1 Feb. 12, 2004

Related U.S. Application Data

(63) Continuation of application No. 10/005,408, filed on Nov. 8, 2001, now abandoned.

(51) Int. Cl.[7] ..... B65D 85/02

(52) U.S. Cl. ..... 242/588.1; 242/588.6; 242/597.2; 242/597.4; 242/608.5

(58) Field of Search ..... 242/588.1, 588.6, 242/597.4, 597.2, 608.5

(56) References Cited

U.S. PATENT DOCUMENTS 1,394,177 A 10/1921 Jones
2,483,528 A 10/1949 Christoff
2,525,992 A 10/1950 Wynn
2,542,580 A 2/1951 Sato
2,683,000 A 7/1954 Beiderwell
2,846,160 A 8/1958 Thomason
2,982,491 A 5/1961 Beiderwell
3,013,378 A 12/1961 Newton, Jr.
3,134,556 A 5/1964 Wasson
3,249,319 A 5/1966 Wasson
3,333,784 A 8/1967 Fisher
4,462,555 A 7/1984 Olson et al.
4,726,179 A 2/1988 Smith et al.
4,844,373 A 7/1989 Fike, Sr.
6,145,780 A 11/2000 Fontana
6,216,978 B1 4/2001 Rodriguez

*Primary Examiner*—Kathy Matecki
*Assistant Examiner*—Sang Kim
(74) *Attorney, Agent, or Firm*—B. Craig Killough

(57) ABSTRACT

A reel for holding and dispensing wire that is used for tying reinforcing steel comprises a spool that rotates within a housing. The spool has a cover that covers one side of the housing and the wire that is contained on the spool. The cover is retained in place over the spool by a retaining member, which is positioned over the cover. The retaining member holds the cover in place relative to the spool by other than threaded means, so that the retaining member does not unscrew and separate from the spool or cover during use.

6 Claims, 3 Drawing Sheets

REEL FOR WIRE

This Application is a continuation of application Ser. No. 10/005,408, filed Nov. 8, 2001 now abandoned. Application claims priority from PCT Application Number PCT/US02/35745, filed on Nov. 6, 2002.

FIELD OF THE INVENTION

This invention relates to spools and reels generally, and is more specifically related to a reel for holding and dispensing wire used for tying reinforcing steel.

BACKGROUND OF THE INVENTION

Lengths of steel, such as steel rods, are used to reinforce concrete that is used in the construction of buildings, bridges and other concrete structures. These lengths of steel are tied together using wire that is specifically manufactured for tying reinforcing steel. In its most common embodiment, the tying wire is 16 gauge black annealed wire, but can also be plastic-coated black annealed wire, stainless steel wire, or other materials, and can come in sizes from 14 to 18 gauge. The wire is packaged from the manufacturer in a coil. The user cuts the wire to the desired length for tying the reinforcing steel.

In order to keep the wire handy, and for ease of use, the wire is contained on a reel which is worn by the worker. The reel comprises belt loops that allow the worker to wear the reel on the belt, and to pull off and cut the wire as needed. The use of this reel makes the wire handy and available for the worker.

Examples of reels for dispensing tie wire are shown in Beiderwell, U.S. Pat. No. 2,683,000 and Beiderwell, U.S. Pat. No. 2,982,491. Prior art reels commonly have a retaining cover or flange which is positioned over a spool. A threaded member retains this cover. The threaded member tends to loosen in use as the spool rotates, allowing the cover and spool to become separated, and reducing the efficiency of the worker. For example, the wire may lodge between the cover and the housing if the cover becomes loose and separates from the housing. Further, workers have a tendency to discard the entire reel, rather than replace the cover, if the cover completely separates from the spool. Still further, since the reel falls apart at what may be a substantial elevation common on construction projects, it may not be practical to repair or replace the reel.

SUMMARY OF THE PRESENT INVENTION

The present invention is a reel for holding and dispensing wire that is used for tying reinforcing steel. The present invention comprises a spool that rotates within a housing. The spool has a cover that covers one side of the housing and the wire that is contained on the spool. The cover is retained in place over the spool by a retaining member, which is positioned over the cover. The retaining member holds the cover in place relative to the spool by other than threaded means, so that the retaining member does not unscrew and separate from the spool or cover during use. Various embodiments of the invention are disclosed herein.

DETAILED DESCRIPTION OF THE PREFERRED EMBODIMENT

Figure 1:
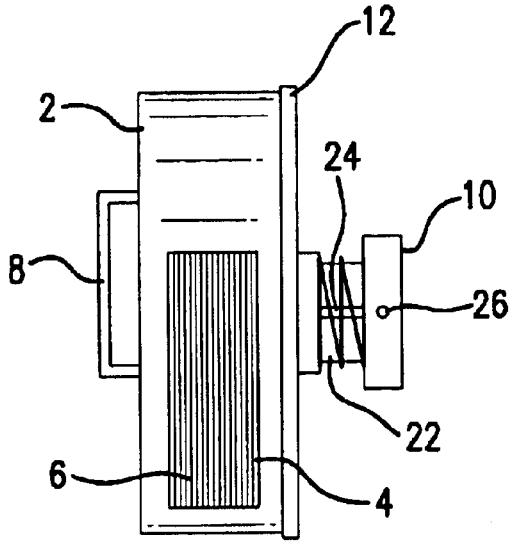
FIG. 1 is a side elevation of the reel.

FIG. 1 shows the reel for holding and dispensing wire used for tying reinforcing steel in position for use. The reel has a housing 2 with a void 4 through which wire 6 is dispensed. The housing has one or more loops 8 through which a belt of a user may be threaded. The retaining member 10 is shown in the "locked" position holding the cover in place.

Figure 2:
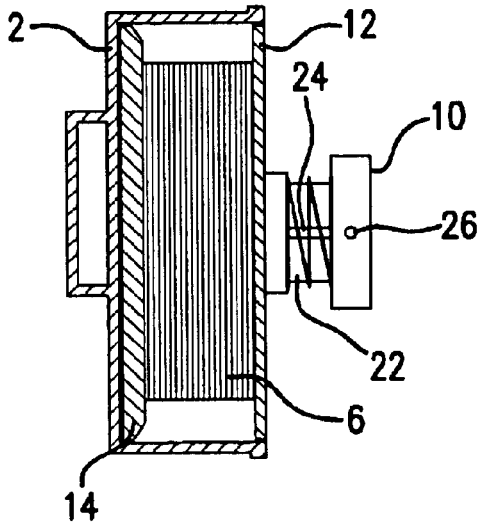
FIG. 2 is a side elevation of the device of FIG. 1, showing a portion of the housing and cover as sectioned.
Figure 3:
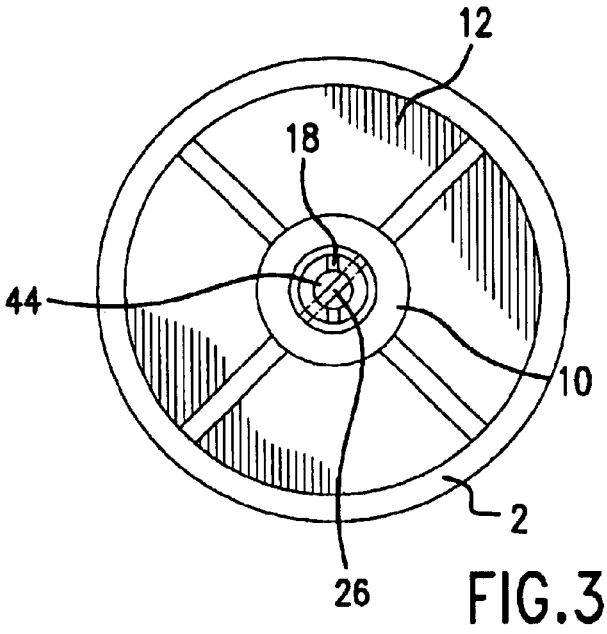
FIG. 3 is a side elevation of the device.

FIG. 2 shows the housing sectioned to reveal the spool 14. The spool contains wire 6 which is stored and dispensed from the reel. The cover 12 is also sectioned, and is shown as being held in place by the retaining member.

FIGS. 4 through 8 show a particular embodiment of the device. The spool has a center arbor 16. On one end of the center arbor, a slot is formed. The slot has a generally horizontal portion 18, with a generally vertical portion 20 extending from one side thereof, and having an enlarged opening on one end of the vertical portion of the slot 20, so that it is generally J shaped. The pin 26 enters the top of the J-shaped slot, and is forced to the bottom of the vertical portion of the J-shaped slot that opens to the outside of the arbor. The pin is then rotated through the vertical portion. Spring biasing holds the pin in the hook portion of the J-shaped slot.

Figure 4:
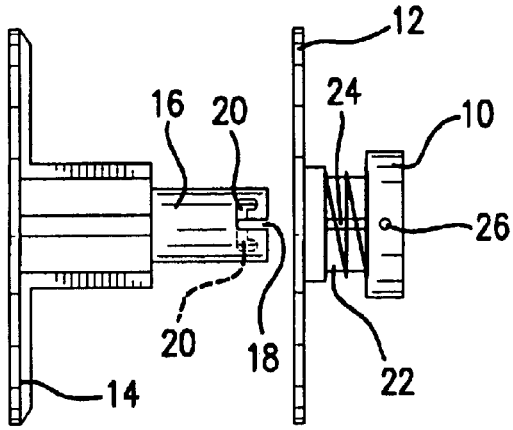
FIG. 4 is a side elevation showing the spool, cover, and retaining member.
Figure 8:
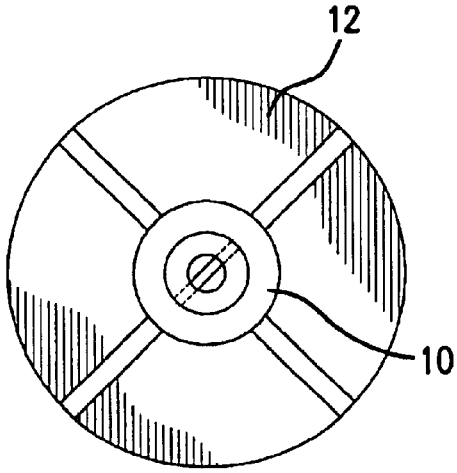
FIG. 8 is a side elevation showing the cover and the retaining member of FIG. 7.
Figure 9:
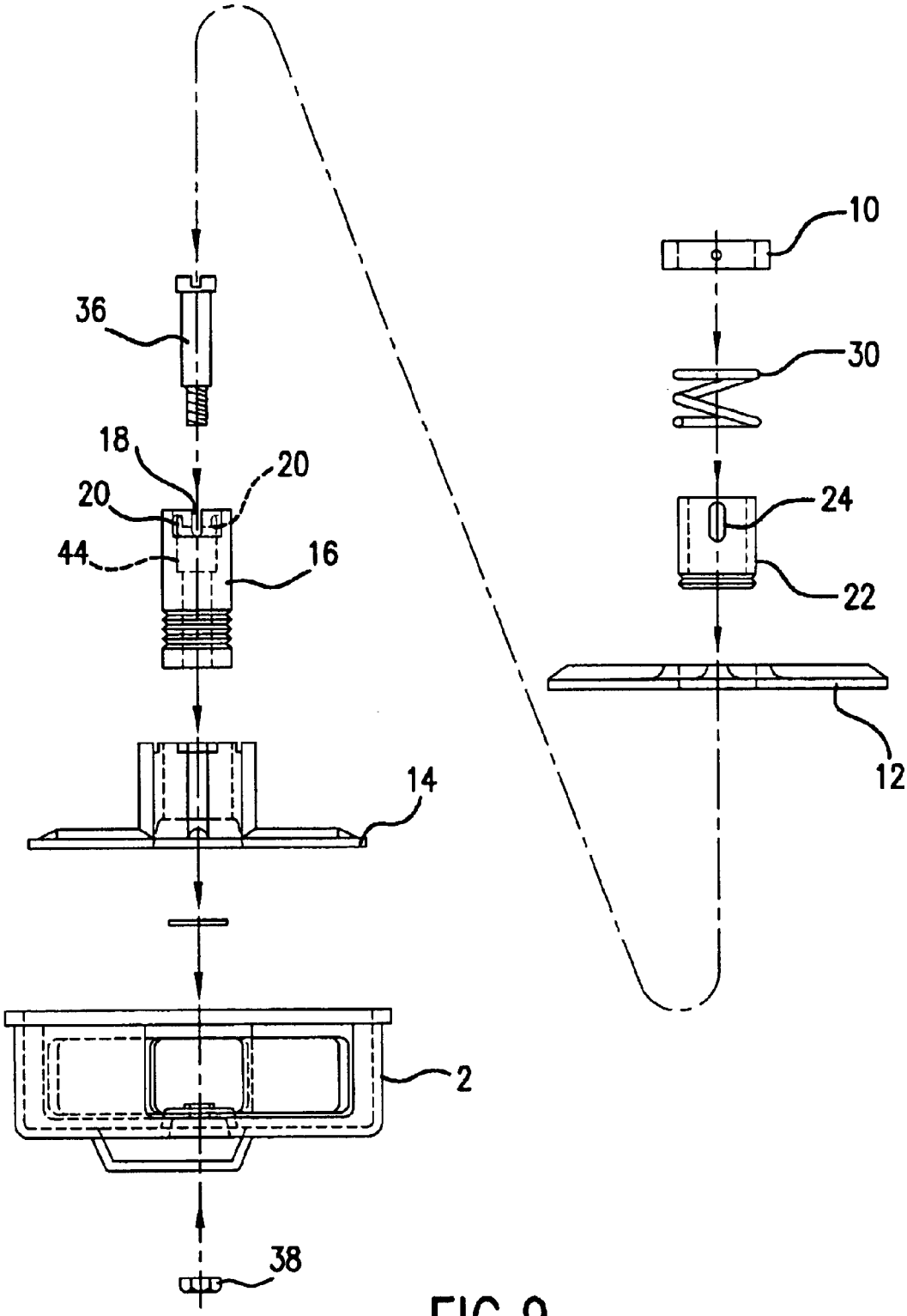
FIG. 9 is an exploded view of the device.

As shown, the center arbor is generally cylindrical on the end, and it has a central void 44 therein. The horizontal portion of the slot is formed linearly through the end of the center arbor, to pass through each wall of the cylinder on a line, as is shown in FIG. 8. As shown in FIG. 4, the vertical portion of the slot extends upwardly from one side of the horizontal slot, and downwardly from the opposite portion of the horizontal slot, with each of the vertical slots being enlarged at the end to accept the pin of the retaining member.

The cover and the retaining member are connected. The cover has an arbor 22, which extends outwardly from the cover opposite the spool. The cover arbor is cylindrical, with an inside diameter which is sufficient to accept the spool arbor 16 therein. A slot 24 is formed in the cover arbor on each side of the arbor and on a line. The retaining member 10 is a generally circular member having a void therein, with the void accepting the cover arbor. A pin 26 is present within the retaining member that extends from one side of the retaining member to the opposite side of the retaining member. The pin is present within the slot 24 of the cover arbor, which keeps the retaining member in position on the cover arbor.

The center arbor has a central void 44 therein in which pin 26 is present. Slots 24 are present on opposite sides of the cover arbor, so that the pin passes through both slots and through the central void of the center arbor.

Figure 5:
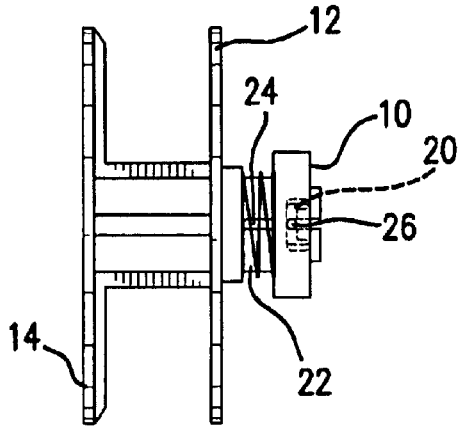
FIG. 5 shows the cover as engaging the spool, with the retaining member engaging the spool.
Figure 6:
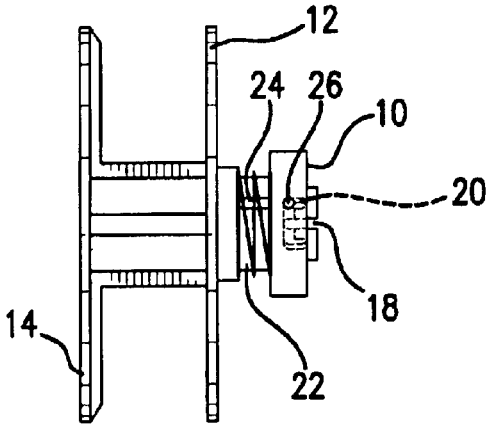
FIG. 6 shows the retaining member rotated slightly from the position of FIG. 5, to further engage the spool.
Figure 7:
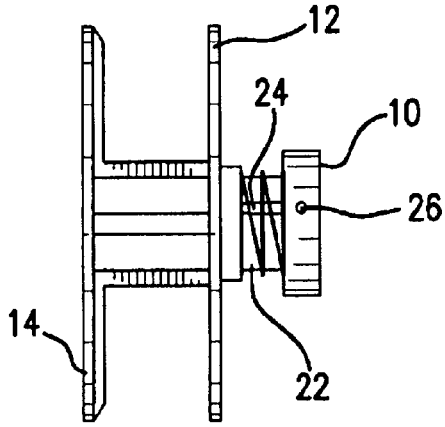
FIG. 7 shows the cover held in place on the spool by the retaining member.

The device is assembled as shown in FIGS. 5 through 7. The cover is positioned over the arbor 16 as shown in FIG. 5, and the retaining member is depressed so that the pin travels toward the spool and to the end of the horizontal portion of the slot in the arbor of the spool. The retaining member is then rotated clockwise, when the device is viewed as in FIG. 6, so that it travels to the end of the vertical portion of the slot in the spool arbor, which is opposite the point where the horizontal slot and vertical slot join. The retaining member is then released, with the spring forcing the pin to the enlarged portion of the vertical slot. The pin is then held in place by the spring biasing 28, which urges the pin and holds it in place in the slot. FIG. 7. The device is then ready for use. To disengage the retaining member, and remove the cover from the spool, the pin is forced against the spring biasing and through the vertical portion of the slot to the horizontal portion of the slot. The combination of spring biasing and manual pressure allows the cover to be removed.

The slot 20 formed in the spool arbor may be J shaped, so that the pin enters the top of the J-shaped slot and is forced to the bottom of the vertical portion of the J-shaped slot that opens to the outside of the center arbor. The retaining member is then rotated to position the pin in the hook of the J-shaped slot. Spring biasing forces the retaining member away from the cover, so that the pin is retained in the hook of the J-shaped slot.

In use, wire is wound around the spool. The device is then assembled for use as described above. The wire is stored until ready for use, whereupon pulling of the wire causes the spool and cover to rotate relative to the housing. The desired length of wire is removed and cut for use.

What is claimed is:

1. A reel, which is adapted to be worn by a user, for holding and dispensing wire, comprising:

a. housing;

b. a spool which is located within said housing and which rotates relative to said housing, said spool having a center arbor, said center arbor comprising a first slot formed therein that intersects an end of said center arbor, a second slot formed therein that intersects said end of said center arbor and is opposite said first slot, and void that is between said first slot and said second slot, wherein said void intersects said end of said center arbor;

c. a cover for said spool which is positioned over said spool and engages said center arbor of said spool; and d. a pin that is positioned over said center arbor and engages said first slot, said second slot and said void in said center arbor when said reel is assembled, wherein said pin holds said cover in position over said spool.

2. A reel, which is adapted to be worn by a user, for holding and dispensing wire as described in claim 1, wherein said reel further comprises a retaining member that engages a cover arbor of said cover, and wherein said cover arbor has a slot on a first side thereof and a slot on a second and opposite side thereof, and wherein said pin is held within said retaining member, and said pin slidably engages said slot on said first side of said cover arbor and said pin slidably engages said slot on said second and opposite side of said cover arbor.

3. A reel, which is adapted to be worn by a user, for holding and dispensing wire as described in claim 2, wherein said retaining member has a void therein that surrounds a portion of said cover arbor, and wherein said pin traverses said void of said retaining member.

4. A reel, which is adapted to be worn by a user, for holding and dispensing wire as described in claim 2, further comprising spring biasing means positioned between said retaining member and said cover, wherein said spring biasing means urges said retaining member away from said cover.

5. A reel, which is adapted to be worn by a user, for holding and dispensing wire as described in claim 3 further comprising spring biasing means positioned between said retaining member and said cover, wherein said spring biasing means urges said retaining member away from said cover.

6. A reel, which is adapted to be worn by a user, for holding and dispensing wire as described in claim 1, wherein said first slot that is formed in said center arbor is a J-shaped slot that receives said pin and said second slot that is formed in said center arbor is a J-shaped slot that receives said pin.

* * * * *